US011697918B2

(12) United States Patent
Kondo et al.

(10) Patent No.: US 11,697,918 B2
(45) Date of Patent: Jul. 11, 2023

(54) HYDRAULIC SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Naoki Hata, Kobe (JP); Nobuyuki Kinoshita, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/637,694

(22) PCT Filed: Jul. 31, 2020

(86) PCT No.: PCT/JP2020/029481
§ 371 (c)(1),
(2) Date: Feb. 23, 2022

(87) PCT Pub. No.: WO2021/039285
PCT Pub. Date: Mar. 4, 2021

(65) Prior Publication Data

US 2022/0290408 A1 Sep. 15, 2022

(30) Foreign Application Priority Data

Aug. 23, 2019 (JP) ..... 2019-152660

(51) Int. Cl.
*E02F 9/22* (2006.01)
*E02F 9/20* (2006.01)
(Continued)

(52) U.S. Cl.
CPC ..... *E02F 9/2228* (2013.01); *E02F 9/2004* (2013.01); *E02F 9/2235* (2013.01);
(Continued)

(58) Field of Classification Search
CPC . F15B 11/166; F15B 2211/355; E02F 9/2228; E02F 9/2282; E02F 9/2285; E02F 9/2296
See application file for complete search history.

(56) References Cited

U.S. PATENT DOCUMENTS 7,168,246 B2 * 1/2007 Toji ..... E02F 9/2235 60/494
7,513,109 B2 * 4/2009 Toji ..... F15B 11/166 91/461
(Continued)

FOREIGN PATENT DOCUMENTS

JP 2017-110672 A 6/2017

*Primary Examiner* — Michael Leslie
(74) *Attorney, Agent, or Firm* — Oliff PLC

(57) ABSTRACT

A hydraulic system of a construction machine includes: control valves interposed between a variable displacement main pump and hydraulic actuators; and first solenoid proportional valves connected to pilot ports of the control valves. The hydraulic system further includes: a regulator that changes a displacement of the main pump; and a second solenoid proportional valve connected to an auxiliary pump by a primary pressure line, the second solenoid proportional valve outputting a secondary pressure to the regulator through a secondary pressure line. A switching valve is interposed between the auxiliary pump and the first solenoid proportional valves, and includes a pilot port that is connected to the secondary pressure line by a pilot line.

15 Claims, 3 Drawing Sheets

(51) Int. Cl.

| | |
|---|---|
| ***E02F 9/24*** | (2006.01) |
| ***F15B 13/044*** | (2006.01) |
| ***F15B 11/16*** | (2006.01) |

(52) U.S. Cl.

CPC ..... *E02F 9/2267* (2013.01); *E02F 9/2282* (2013.01); *E02F 9/2285* (2013.01); *E02F 9/2292* (2013.01); *E02F 9/2296* (2013.01); *E02F 9/24* (2013.01); *F15B 11/166* (2013.01); *F15B 13/044* (2013.01); *F15B 2211/355* (2013.01)

(56) References Cited

U.S. PATENT DOCUMENTS

| | | | | |
|---|---|---|---|---|
| 9,932,995 | B2 * | 4/2018 | Kondo | E02F 9/2282 |
| 10,227,090 | B2 * | 3/2019 | Kondo | E02F 9/2285 |
| 11,105,348 | B2 * | 8/2021 | Kim | E02F 9/2292 |
| 11,220,805 | B2 * | 1/2022 | Kondo | E02F 9/2228 |
| 2016/0145835 | A1 * | 5/2016 | Kim | E02F 9/2282 60/431 |
| 2017/0166253 | A1 | 6/2017 | Kondo | |
| 2022/0267997 | A1 * | 8/2022 | Kondo | E02F 9/2296 |
| 2022/0282453 | A1 * | 9/2022 | Kondo | E02F 9/2228 |
| 2022/0316186 | A1 * | 10/2022 | Kondo | E02F 9/2267 |
| 2022/0316187 | A1 * | 10/2022 | Kondo | E02F 9/2285 |
| 2022/0364329 | A1 * | 11/2022 | Kondo | F15B 13/06 |

* cited by examiner

HYDRAULIC SYSTEM OF CONSTRUCTION MACHINE

TECHNICAL FIELD

The present invention relates to a hydraulic system of a construction machine.

BACKGROUND ART

In a hydraulic system installed in construction machines such as hydraulic excavators and hydraulic cranes, control valves are interposed between a main pump and hydraulic actuators. Each of the control valves controls supply and discharge of hydraulic oil to and from a corresponding one of the hydraulic actuators.

Generally speaking, each control valve includes: a spool disposed in a housing; and a pair of pilot ports for moving the spool. In a case where an operation device that outputs an electrical signal is used as an operation device to move the control valve, solenoid proportional valves are connected to the respective pilot ports of the control valve, and the control valve is driven by the solenoid proportional valves.

For example, Patent Literature 1 discloses a configuration for bringing the control valve back to its neutral position when a failure has occurred in the solenoid proportional valves for driving the control valve. In this configuration, a solenoid switching valve is interposed between an auxiliary pump and the solenoid proportional valves for driving the control valve. When a failure has occurred in the solenoid proportional valves for driving the control valve, the solenoid switching valve is switched from an open position to a closed position to stop the supply of the hydraulic oil from the auxiliary pump to the solenoid proportional valves. That is, when a failure has occurred in the solenoid proportional valves for driving the control valve, even if an operator operates the operation device, the control valve is kept in the neutral position and the operation performed on the operation device is invalidated.

CITATION LIST

Patent Literature

PTL 1: Japanese Laid-Open Patent Application Publication No. 2017-110672

SUMMARY OF INVENTION

Technical Problem

However, the configuration disclosed in Patent Literature 1 requires a solenoid valve that is dedicated for invalidating an operation performed on the operation device.

In view of the above, an object of the present invention is to provide a hydraulic system of a construction machine, the hydraulic system making it possible to invalidate operations performed on operation devices without using a solenoid valve that is dedicated for invalidating operations performed on the operation devices.

Solution to Problem

In order to solve the above-described problems, the inventors of the present invention have paid attention to the fact that, among various hydraulic systems of construction machines, some of them are configured such that the displacement of a variable displacement main pump thereof is changed by a solenoid proportional valve. Then, the inventors have come up with an idea that it may be possible to use the solenoid proportional valve for invalidating an operation performed on an operation device. The present invention has been made from such a technological point of view.

Specifically, a hydraulic system of a construction machine according to the present invention includes: a variable displacement main pump; control valves interposed between the main pump and hydraulic actuators, each control valve including pilot ports; first solenoid proportional valves connected to the pilot ports of the control valves; operation devices to move the control valves, each operation device outputting an electrical signal corresponding to an operating amount of the operation device; a controller that controls the first solenoid proportional valves based on the electrical signals outputted from the operation devices; a regulator that changes a displacement of the main pump based on a signal pressure; a second solenoid proportional valve connected to an auxiliary pump by a primary pressure line, the second solenoid proportional valve outputting a secondary pressure as the signal pressure to the regulator through a secondary pressure line; and a switching valve interposed between the auxiliary pump and the first solenoid proportional valves, the switching valve including a pilot port that is connected to the secondary pressure line by a pilot line, the switching valve switching between a closed position and an open position in accordance with a pilot pressure led to the pilot port.

According to the above configuration, whether to switch the switching valve, which is interposed between the auxiliary pump and the first solenoid proportional valves, to the closed position or to the open position, i.e., whether to invalidate or validate operations performed on the operation devices, can be switched based on the secondary pressure of the second solenoid proportional valve. Also, the displacement of the main pump can be changed based on the secondary pressure of the second solenoid proportional valve. This allows the second solenoid proportional valve, which is a single valve, to have two functions. Therefore, a solenoid valve dedicated for invalidating operations performed on the operation devices is unnecessary.

For example, the regulator may increase the displacement of the main pump in accordance with increase in the signal pressure, and the switching valve may switch from the closed position to the open position when the pilot pressure led to the pilot port of the switching valve becomes higher than or equal to a setting value.

The above hydraulic system may further include a selector that receives a selection of operation lock, which is a selection to invalidate operations performed on the operation devices, or receives a selection of operation lock release, which is a selection to validate operations performed on the operation devices. While the selector is receiving the selection of operation lock, the controller may control the second solenoid proportional valve, such that the secondary pressure of the second solenoid proportional valve is lower than the setting value. While the selector is receiving the selection of operation lock release, the controller may control the second solenoid proportional valve, such that the secondary pressure of the second solenoid proportional valve is higher than the setting value. According to this configuration, when an operator makes the selection of operation lock with the selector, operations performed on the operation devices are invalidated, whereas when the operator makes the selection of operation lock release with the selector, operations performed on the operation devices are validated.

The setting value may be a first setting value. The regulator may keep the displacement of the main pump to a minimum when the signal pressure is lower than or equal to a second setting value. The first setting value may be lower than the second setting value. According to this configuration, the switching valve can be switched from the closed position to the open position while the displacement of the main pump is kept to the minimum.

The main pump, the auxiliary pump, the regulator, and the second solenoid proportional valve may be integrated together to collectively serve as a pump unit. The switching valve may be connected to the pump unit by a pipe that is a part of a pump line connecting between the switching valve and the auxiliary pump and by a pipe that is a part of the pilot line. This configuration makes it possible to relatively freely determine the position at which to dispose the switching valve in the construction machine The main pump, the auxiliary pump, the regulator, the second solenoid proportional valve, and the switching valve may be integrated together to collectively serve as a pump unit. According to this configuration, the number of pipes extending from the pump unit and intended for the first solenoid proportional valves may be only one.

Advantageous Effects of Invention

The present invention makes it possible to invalidate operations performed on operation devices without using a solenoid valve that is dedicated for invalidating operations performed on the operation devices.

DESCRIPTION OF EMBODIMENTS

Figure 1:
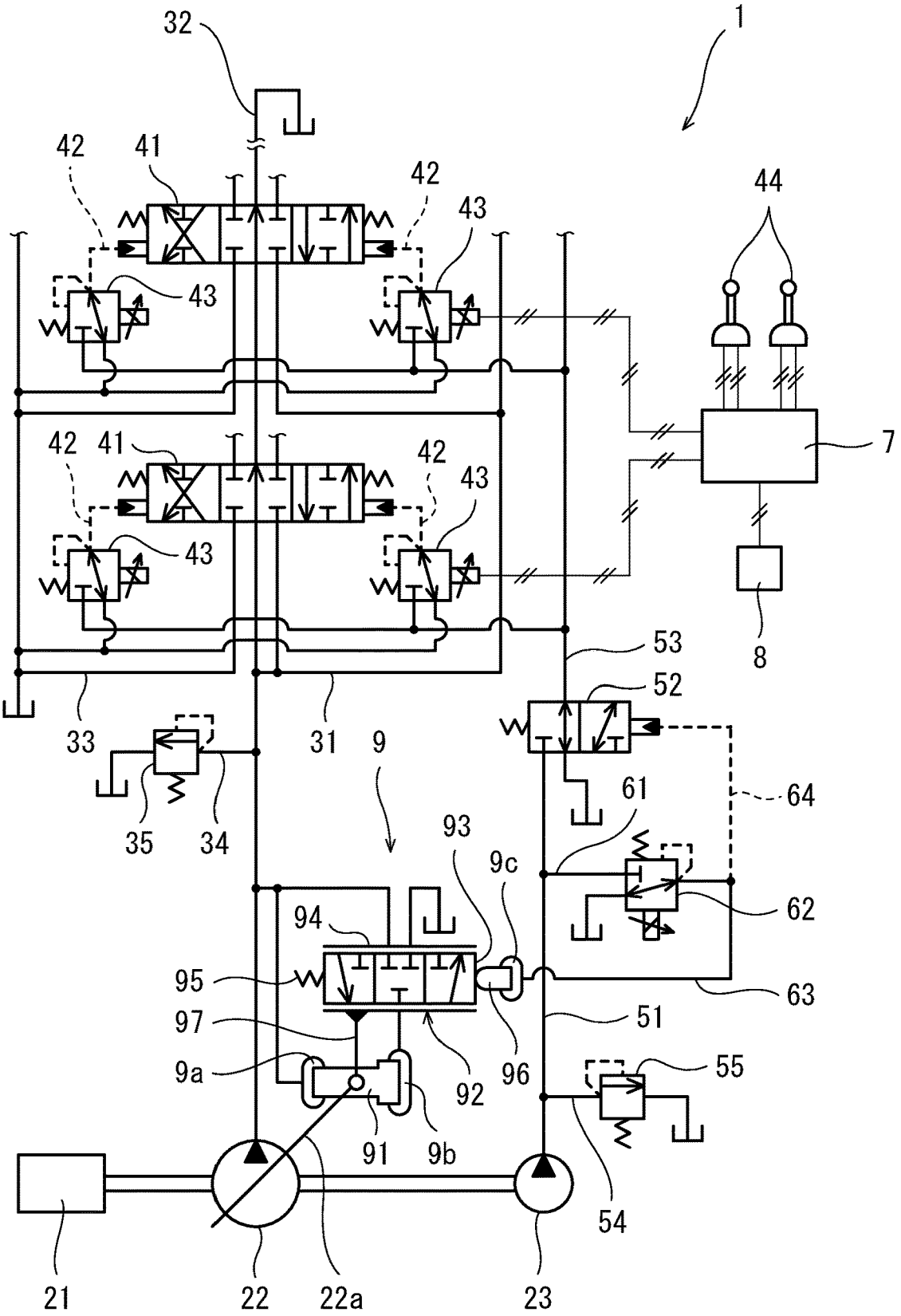
FIG. 1 shows a schematic configuration of a hydraulic system of a construction machine according to one embodiment of the present invention.
Figure 2:
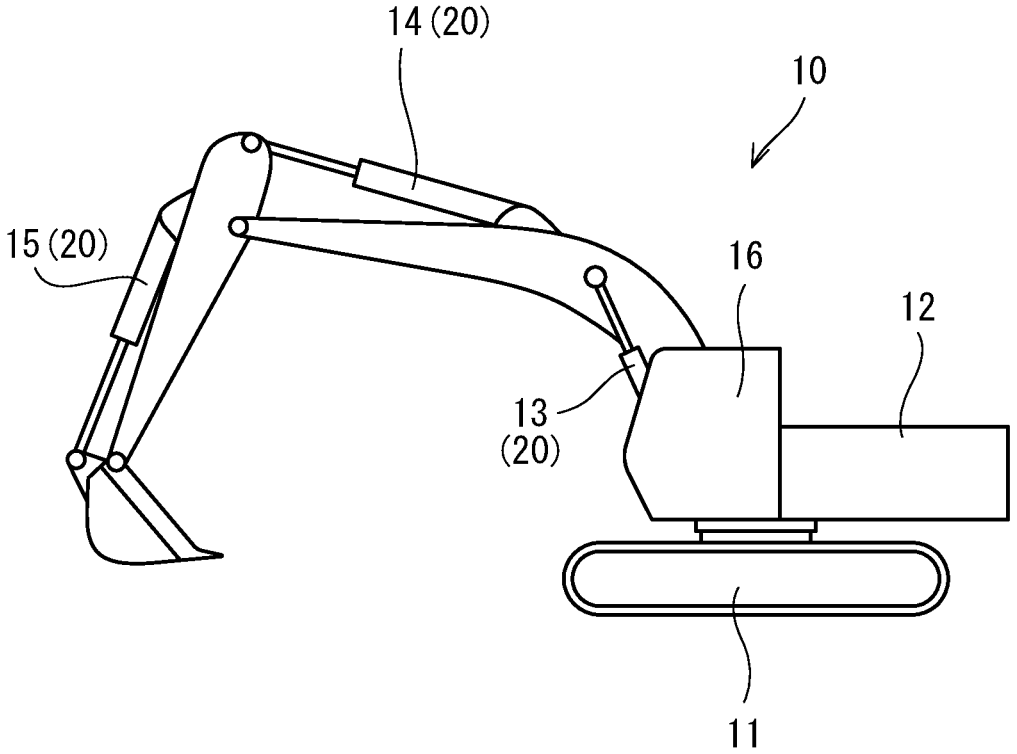
FIG. 2 is a side view of a hydraulic excavator, which is one example of the construction machine.

FIG. 1 shows a hydraulic system 1 of a construction machine according to one embodiment of the present invention. FIG. 2 shows a construction machine 10, in which the hydraulic system 1 is installed. Although the construction machine 10 shown in FIG. 2 is a hydraulic excavator, the present invention is applicable to other construction machines, such as a hydraulic crane.

The construction machine 10 shown in FIG. 2 is a self-propelled construction machine, and includes a traveling unit 11. The construction machine 10 further includes: a slewing unit 12 slewably supported by the traveling unit 11; and a boom that is luffed relative to the slewing unit 12. An arm is swingably coupled to the distal end of the boom, and a bucket is swingably coupled to the distal end of the arm. The slewing unit 12 is equipped with a cabin 16 including an operator's seat. The construction machine 10 need not be of a self-propelled type.

The hydraulic system 1 includes, as hydraulic actuators 20, a boom cylinder 13, an arm cylinder 14, and a bucket cylinder 15, which are shown in FIG. 2, an unshown pair of left and right travel motors, and an unshown slewing motor. The boom cylinder 13 luffs the boom. The arm cylinder 14 swings the arm. The bucket cylinder 15 swings the bucket.

As shown in FIG. 1, the hydraulic system 1 further includes a main pump 22, which supplies hydraulic oil to the aforementioned hydraulic actuators 20. In FIG. 1, the hydraulic actuators 20 are not shown for the purpose of simplifying the drawing.

The main pump 22 is driven by an engine 21. Alternatively, the main pump 22 may be driven by an electric motor. The engine 21 also drives an auxiliary pump 23. The number of main pumps 22 may be more than one.

The main pump 22 is a variable displacement pump whose displacement, i.e., the amount of hydraulic oil delivered per rotation of the pump, is variable. The displacement of the main pump 22 may be controlled by electrical positive control, or may be controlled by hydraulic negative control. Alternatively, the delivery flow rate (i.e., the amount of hydraulic oil delivered per unit time) of the main pump 22 may be controlled by load-sensing control. In the present embodiment, the main pump 22 is a swash plate pump including a swash plate 22*a*. Alternatively, the main pump 22 may be a bent axis pump.

The displacement (delivery flow rate) of the main pump 22 is changed by a regulator 9. The regulator 9 is fed with a signal pressure, and based on the signal pressure, the regulator 9 changes the displacement of the main pump 22. In the present embodiment, the regulator 9 increases the displacement of the main pump 22 in accordance with increase in the signal pressure.

To be more specific, the regulator 9 includes a servo piston 91 and an adjustment valve 92. The servo piston 91 is coupled to the swash plate 22*a* of the main pump 22. The adjustment valve 92 is intended for driving the servo piston 91. In the regulator 9, a first pressure receiving chamber 9*a* and a second pressure receiving chamber 9*b* are formed. The delivery pressure of the main pump 22 is led into the first pressure receiving chamber 9*a*, and a control pressure is led into the second pressure receiving chamber 9*b*. The servo piston 91 includes a first end portion and a second end portion. The second end portion has a greater diameter than that of the first end portion. The first end portion is exposed in the first pressure receiving chamber 9*a*, and the second end portion is exposed in the second pressure receiving chamber 9*b*.

The adjustment valve 92 is intended for adjusting the control pressure led into the second pressure receiving chamber 9*b*. Specifically, the adjustment valve 92 includes a spool 93 and a sleeve 94. The spool 93 shifts in a direction to decrease the control pressure (i.e., a displacement-increasing direction; to the left in FIG. 1), and also shifts in a direction to increase the control pressure (i.e., a displacement-decreasing direction; to the right in FIG. 1). The sleeve 94 accommodates the spool 93 therein. The spool 93 is pressed by a flow rate control piston 96 to shift in the displacement-increasing direction, and is urged by the urging force of a spring 95 to shift in the displacement-decreasing direction. The spring 95 is disposed opposite the flow rate control piston 96, with the spool 93 positioned between the spring 95 and the flow rate control piston 96.

The sleeve 94 is coupled to the servo piston 91 by a feedback lever 97. In the sleeve 94, a pump port, a tank port, and an output port are formed (the output port communicates with the second pressure receiving chamber 9*b*). The output port is blocked from both the pump port and the tank port, or communicates with the pump port or the tank port, in accordance with a positional relationship between the sleeve 94 and the spool 93. When the flow rate control piston 96 causes the spool 93 to shift in the displacement-increasing direction or the displacement-decreasing direction, the spool 93 and the sleeve 94 are brought into such a positional relationship with each other that forces applied from both sides of the servo piston 91 (each force=pressure×pressure receiving area of the servo piston) are balanced, and thereby the control pressure is adjusted.

Further, an actuating chamber 9*c*, which applies the aforementioned signal pressure to the flow rate control piston 96, is formed in the regulator 9. That is, the higher the signal pressure, the more the flow rate control piston 96 presses the spool 93 to shift in the displacement-increasing direction.

Figure 3A:
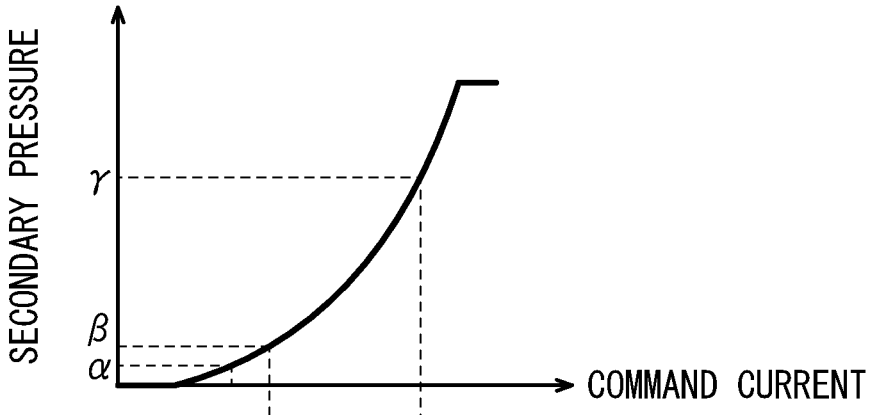
FIG. 3A is a graph showing a relationship between a command current to a second solenoid proportional valve and a secondary pressure of the second solenoid proportional valve.
Figure 3B:
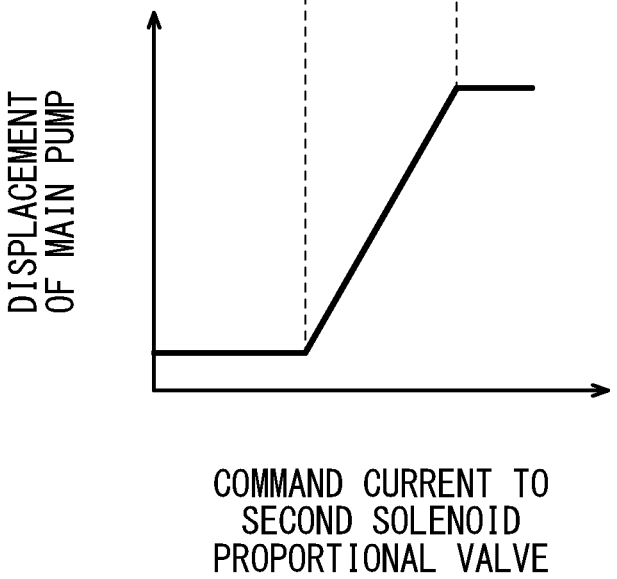
FIG. 3B is a graph showing a relationship between the command current to the second solenoid proportional valve and a displacement of a main pump.

As shown in FIGS. 3A and 3B, when the signal pressure is lower than or equal to a setting value β (corresponding to a second setting value of the present invention), the regulator 9 keeps the displacement of the main pump 22 to a minimum, whereas when the signal pressure is higher than or equal to a setting value γ, the regulator 9 keeps the displacement of the main pump 22 to a maximum. When the signal pressure is between the setting value β and the setting value γ, the displacement of the main pump 22 changes in accordance with the signal pressure.

Returning to FIG. 1, control valves 41 are interposed between the main pump 22 and the hydraulic actuators 20. In the present embodiment, all the control valves 41 are three-position valves. Alternatively, one or more of the control valves 41 may be two-position valves.

All the control valves 4 are connected to the main pump 22 by a supply line 31, and connected to a tank by a tank line 33. Each of the control valves 41 is connected to a corresponding one of the hydraulic actuators 20 by a pair of supply/discharge lines. In a case where the number of main pumps 22 is more than one, the same number of groups of the control valves 41 as the number of main pumps 22 are formed. In each group, the control valves 41 are connected to the corresponding main pump 22 by the supply line 31.

For example, the control valves 41 include: a boom control valve that controls supply and discharge of the hydraulic oil to and from the boom cylinder 13; an arm control valve that controls supply and discharge of the hydraulic oil to and from the arm cylinder 14; and a bucket control valve that controls supply and discharge of the hydraulic oil to and from the bucket cylinder 15.

The supply line 31 includes a main passage and branch passages. The main passage extends from the main pump 22. The branch passages are branched off from the main passage, and connect to the control valves 41. In the present embodiment, a center bypass line 32 is branched off from the main passage of the supply line 31, and the center bypass line 32 extends to the tank. The control valves 41 are disposed on the center bypass line 32. The center bypass line 32 may be eliminated.

A relief line 34 is branched off from the main passage of the supply line 31, and the relief line 34 is provided with a relief valve 35 for the main pump 22. The relief line 34 may be branched off from the center bypass line 32 at a position upstream of all the control valves 41. Alternatively, the relief line 34 may be branched off from the center bypass line 32 at a position between particular control valves 41.

Each control valve 41 includes: a spool disposed in a housing; and a pair of pilot ports for moving the spool. For example, the housings of all the control valves 41 may be integrated together to form a multi-control valve unit. The pilot ports of each control valve 41 are connected to respective first solenoid proportional valves 43 by respective pilot lines 42.

Each first solenoid proportional valve 43 is a direct proportional valve outputting a secondary pressure that indicates a positive correlation with a command current. Alternatively, each first solenoid proportional valve 43 may be an inverse proportional valve outputting a secondary pressure that indicates a negative correlation with the command current.

All the first solenoid proportional valves 43 are connected to a switching valve 52 by a distribution line 53. The distribution line 53 includes a main passage and branch passages. The main passage extends from the switching valve 52. The branch passages are branched off from the main passage, and connect to the first solenoid proportional valves 43.

The switching valve 52 is connected to the auxiliary pump 23 by a pump line 51. A relief line 54 is branched off from the pump line 51, and the relief line 54 is provided with a relief valve 55 for the auxiliary pump 23. The relief pressure of the relief valve 55 is set sufficiently high (e.g., 4 MPa) so that the spool of each control valve 41 can move to the stroke end. The relief pressure of the relief valve 55 is higher, to some extent, than the setting value γ of the regulator 9 (the signal pressure that brings the displacement of the main pump 22 to the maximum).

The switching valve 52 interposed between the auxiliary pump 23 and all the first solenoid proportional valves 43 includes a pilot port, and switches between a closed position and an open position in accordance with a pilot pressure led to the pilot port. In the present embodiment, the closed position is the neutral position of the switching valve 52. That is, when the pilot pressure becomes higher than or equal to a setting value α (corresponding to a first setting value of the present invention), the switching valve 52 switches from the closed position to the open position.

When the switching valve 52 is in the closed position, the switching valve 52 blocks the pump line 51, and brings the distribution line 53 into communication with the tank. When the switching valve 52 is in the open position, the switching valve 52 brings the pump line 51 into communication with the distribution line 53. In other words, in a state where the switching valve 52 is kept in the closed position, the supply of the hydraulic oil from the auxiliary pump 23 to the first solenoid proportional valves 43 is stopped, and the primary pressure of each first solenoid proportional valve 43 is zero. Accordingly, even when electric currents are fed to the first solenoid proportional valves 43, the control valves 41 do not move.

As shown in FIG. 3A, desirably, the setting value α of the switching valve 52 is set to be lower than the setting value β, which brings the displacement of the main pump 22 to the minimum, because, with such setting of the setting value α, the switching valve 52 can be switched from the closed position to the open position while the displacement of the main pump 22 is kept to the minimum. For example, the setting value α is 0.1 to 0.6 MPa, and the setting value β is 0.7 to 1.0 MPa.

The auxiliary pump 23 is connected also to a second solenoid proportional valve 62 by a primary pressure line 61, and the second solenoid proportional valve 62 is connected to the actuating chamber 9*c* of the regulator 9 by a secondary pressure line 63. That is, the second solenoid proportional valve 62 outputs a secondary pressure as the aforementioned signal pressure to the regulator 9 through the secondary pressure line 63. The upstream portion of the primary pressure line 61 and the upstream portion of the pump line 51 merge together to form a shared passage.

In the present embodiment, the second solenoid proportional valve 62 is a direct proportional valve outputting a secondary pressure that indicates a positive correlation with a command current. The pilot port of the switching valve 52 is connected to the secondary pressure line 63 by a pilot line 64.

Operation devices 44 to move the control valves 41 are disposed in the aforementioned cabin 16. Each operation device 44 includes an operating unit (an operating lever or a foot pedal) that receives an operation for moving a corresponding one of the hydraulic actuators 20, and outputs an electrical signal corresponding to an operating amount of the operating unit (e.g., an inclination angle of the operating lever).

For example, the operation devices 44 include a boom operation device, an arm operation device, and a bucket operation device, each of which includes an operating lever. The operating lever of the boom operation device receives a boom raising operation and a boom lowering operation. The operating lever of the arm operation device receives an arm crowding operation and an arm pushing operation. The operating lever of the bucket operation device receives a bucket excavating operation and a bucket dumping operation. For example, when the operating lever of the boom operation device is inclined in a boom raising direction, the boom operation device outputs a boom raising electrical signal whose magnitude corresponds to the inclination angle of the operating lever.

The electrical signal outputted from each operation device 44 is inputted to a controller 7. For example, the controller 7 is a computer including memories such as a ROM and RAM, a storage such as a HDD, and a CPU. The CPU executes a program stored in the ROM or HDD.

The controller 7 controls the first solenoid proportional valves 43 based on the electrical signals outputted from the operation devices 44. FIG. 1 shows only part of signal lines for simplifying the drawing. For example, when a boom raising electrical signal is outputted from the boom operation device, the controller 7 feeds a command current to the first solenoid proportional valve 43 connected to a boom raising pilot port of the boom control valve, and increases the command current in accordance with increase in the boom raising electrical signal.

The controller 7 controls the second solenoid proportional valve 62, such that the secondary pressure of the second solenoid proportional valve 62 increases in accordance with increase in the operating amount of each operation device 44. Accordingly, the displacement (delivery flow rate) of the main pump 22 increases in accordance with increase in the operating amount of each operation device 44.

A selector 8 is disposed in the cabin 16. With the selector 8, an operator selects whether to invalidate or validate operations performed on all the operation devices 44. The selector 8 receives a selection of operation lock, which is a selection to invalidate operations performed on the operation devices 44, or receives a selection of operation lock release, which is a selection to validate operations performed on the operation devices 44.

For example, the selector 8 may be a micro switch or limit switch including a safety lever, and by shifting or swinging the safety lever, the selection of operation lock or the selection of operation lock release can be made. Alternatively, the selector 8 may be a push button switch including a button, and by pushing or not pushing the button, the selection of operation lock or the selection of operation lock release can be made.

The controller 7 controls the second solenoid proportional valve 62 in accordance with a selection status of the selector 8 in the following manner.

While the selector 8 is receiving the selection of operation lock, the controller 7 controls the second solenoid proportional valve 62, such that the secondary pressure of the second solenoid proportional valve 62 is lower than the setting value $\alpha$ of the switching valve 52 as shown in FIG. 3A. As a result, the displacement of the main pump 22 is kept to the minimum, and also, the switching valve 52 is kept in the closed position. At the time, the controller 7 may feed no command current to the second solenoid proportional valve 62, or may feed a command current lower than the electric current value corresponding to the setting value $\alpha$ to the second solenoid proportional valve 62.

While the selector 8 is receiving the selection of operation lock release, the controller 7 controls the second solenoid proportional valve 62, such that the secondary pressure of the second solenoid proportional valve 62 is higher than the setting value $\alpha$ of the switching valve 52. As a result, the switching valve 52 is switched to the open position.

As described above, while the selector 8 is receiving the selection of operation lock release, the secondary pressure of the second solenoid proportional valve 62 increases in accordance with increase in the operating amount of each operation device 44. Specifically, when none of the operation devices 44 are operated, the controller 7 feeds a standby current to the second solenoid proportional valve 62 as a command current to keep the secondary pressure of the second solenoid proportional valve 62 to a predetermined value c, which is higher than the setting value $\alpha$ of the switching valve 52. In a case where the setting value $\alpha$ of the switching valve 52 is lower than the setting value $\beta$ of the regulator 9, the predetermined value c is lower than or equal to the setting value $\beta$, and in a case where the setting value $\alpha$ of the switching valve 52 is higher than the setting value $\beta$ of the regulator 9, the predetermined value c is close to the setting value $\alpha$. Accordingly, the displacement of the main pump 22 is kept at, or kept close to, the minimum.

When any one of the operation devices 44 is operated while the selector 8 is receiving the selection of operation lock release, the secondary pressure of the second solenoid proportional valve 62 is adjusted to be higher than the predetermined value $\varepsilon$. Thus, while the selector 8 is receiving the selection of operation lock release, the secondary pressure of the second solenoid proportional valve 62 changes between the predetermined value c and the maximum value in accordance with the operating amount of the operation device 44.

As described above, in the hydraulic system 1 of the present embodiment, whether to switch the switching valve 52, which is interposed between the auxiliary pump 23 and the first solenoid proportional valves 43, to the closed position or to the open position, i.e., whether to invalidate or validate operations performed on the operation devices 44, can be switched based on the secondary pressure of the second solenoid proportional valve 62. Also, the displacement of the main pump 22 can be changed based on the secondary pressure of the second solenoid proportional valve 62. This allows the second solenoid proportional valve 62, which is a single valve, to have two functions. Therefore, a solenoid valve dedicated for invalidating operations performed on the operation devices 44 is unnecessary.

Since the present embodiment includes the selector 8, when the operator makes the selection of operation lock with the selector 8, operations performed on the operation devices 44 are invalidated, whereas when the operator makes the selection of operation lock release with the selector 8, operations performed on the operation devices 44 are validated.

In general, the main pump 22, the auxiliary pump 23, the regulator 9, and the second solenoid proportional valve 62 are integrated together to collectively serve as a pump unit. Accordingly, the switching valve 52 may be connected to the pump unit by a pipe that is a part of the pump line 51 and a pipe that is a part of the pilot line 64. This configuration makes it possible to relatively freely determine the position at which to dispose the switching valve 52 in the construction machine.

Alternatively, the switching valve 52 may be integrated with the main pump 22, the auxiliary pump 23, the regulator 9, and the second solenoid proportional valve 62, and thereby incorporated in the pump unit. In a case where the switching valve 52 is a separate component from the pump unit, it is necessary to extend two pipes from the pump unit as pipes for the first solenoid proportional valves 43 (other than a tank pipe). On the other hand, in a case where the switching valve 52 is incorporated in the pump unit, the number of pipes extending from the pump unit and intended for the first solenoid proportional valves 43 may be only one (other than a tank pipe).

(Variations)

The present invention is not limited to the above-described embodiment. Various modifications can be made without departing from the scope of the present invention.

For example, the regulator 9 may be configured conversely to the above-described embodiment, i.e., the regulator 9 may decrease the displacement of the main pump 22 in accordance with increase in the signal pressure. In this case, the switching valve 52 switches from the open position to the closed position when the pilot pressure becomes higher than or equal to a relatively high setting value. In the case where the regulator 9 is configured conversely to the above-described embodiment, the second solenoid proportional valve 62 may be either a direct proportional valve or an inverse proportional valve.

REFERENCE SIGNS LIST

1 hydraulic system
20 hydraulic actuator
22 main pump
23 auxiliary pump
41 control valve
43 first solenoid proportional valve
44 operation device
51 pump line
52 switching valve
61 primary pressure line
62 second solenoid proportional valve
63 secondary pressure line
64 pilot line
7 controller
8 selector
9 regulator

The invention claimed is:

1. A hydraulic system of a construction machine, comprising:

a variable displacement main pump;

control valves interposed between the main pump and hydraulic actuators, each control valve including pilot ports;

first solenoid proportional valves connected to the pilot ports of the control valves;

operation devices to move the control valves, each operation device outputting an electrical signal corresponding to an operating amount of the operation device;

a controller that controls the first solenoid proportional valves based on the electrical signals outputted from the operation devices;

a regulator that changes a displacement of the main pump based on a signal pressure;

a second solenoid proportional valve connected to an auxiliary pump by a primary pressure line, the second solenoid proportional valve outputting a secondary pressure as the signal pressure to the regulator through a secondary pressure line; and a switching valve interposed between the auxiliary pump and the first solenoid proportional valves, the switching valve including a pilot port that is connected to the secondary pressure line by a pilot line, the switching valve switching between a closed position and an open position in accordance with a pilot pressure led to the pilot port.

2. The hydraulic system of a construction machine according to claim 1, wherein the regulator increases the displacement of the main pump in accordance with increase in the signal pressure, and the switching valve switches from the closed position to the open position when the pilot pressure led to the pilot port of the switching valve becomes higher than or equal to a setting value.

3. The hydraulic system of a construction machine according to claim 2, further comprising a selector that receives a selection of operation lock, which is a selection to invalidate operations performed on the operation devices, or receives a selection of operation lock release, which is a selection to validate operations performed on the operation devices, wherein while the selector is receiving the selection of operation lock, the controller controls the second solenoid proportional valve, such that the secondary pressure of the second solenoid proportional valve is lower than the setting value, and while the selector is receiving the selection of operation lock release, the controller controls the second solenoid proportional valve, such that the secondary pressure of the second solenoid proportional valve is higher than the setting value.

4. The hydraulic system of a construction machine, according to claim 3, wherein the setting value is a first setting value, the regulator keeps the displacement of the main pump to a minimum when the signal pressure is lower than or equal to a second setting value, and the first setting value is lower than the second setting value.

5. The hydraulic system of a construction machine according to claim 4, wherein the main pump, the auxiliary pump, the regulator, and the second solenoid proportional valve are integrated together to collectively serve as a pump unit, and the switching valve is connected to the pump unit by a pipe that is a part of a pump line connecting between the switching valve and the auxiliary pump and by a pipe that is a part of the pilot line.

6. The hydraulic system of a construction machine according to claim 4, wherein the main pump, the auxiliary pump, the regulator, the second solenoid proportional valve, and the switching valve are integrated together to collectively serve as a pump unit.

7. The hydraulic system of a construction machine according to claim 3, wherein the main pump, the auxiliary pump, the regulator, and the second solenoid proportional valve are integrated together to collectively serve as a pump unit, and the switching valve is connected to the pump unit by a pipe that is a part of a pump line connecting between the switching valve and the auxiliary pump and by a pipe that is a part of the pilot line.

8. The hydraulic system of a construction machine according to claim 3, wherein the main pump, the auxiliary pump, the regulator, the second solenoid proportional valve, and the switching valve are integrated together to collectively serve as a pump unit.

9. The hydraulic system of a construction machine, according to claim 2, wherein the setting value is a first setting value, the regulator keeps the displacement of the main pump to a minimum when the signal pressure is lower than or equal to a second setting value, and the first setting value is lower than the second setting value.

10. The hydraulic system of a construction machine according to claim 9, wherein the main pump, the auxiliary pump, the regulator, and the second solenoid proportional valve are integrated together to collectively serve as a pump unit, and the switching valve is connected to the pump unit by a pipe that is a part of a pump line connecting between the switching valve and the auxiliary pump and by a pipe that is a part of the pilot line.

11. The hydraulic system of a construction machine according to claim 9, wherein the main pump, the auxiliary pump, the regulator, the second solenoid proportional valve, and the switching valve are integrated together to collectively serve as a pump unit.

12. The hydraulic system of a construction machine according to claim 2, wherein the main pump, the auxiliary pump, the regulator, and the second solenoid proportional valve are integrated together to collectively serve as a pump unit, and the switching valve is connected to the pump unit by a pipe that is a part of a pump line connecting between the switching valve and the auxiliary pump and by a pipe that is a part of the pilot line.

13. The hydraulic system of a construction machine according to claim 2, wherein the main pump, the auxiliary pump, the regulator, the second solenoid proportional valve, and the switching valve are integrated together to collectively serve as a pump unit.

14. The hydraulic system of a construction machine according to claim 1, wherein the main pump, the auxiliary pump, the regulator, and the second solenoid proportional valve are integrated together to collectively serve as a pump unit, and the switching valve is connected to the pump unit by a pipe that is a part of a pump line connecting between the switching valve and the auxiliary pump and by a pipe that is a part of the pilot line.

15. The hydraulic system of a construction machine according to claim 1, wherein the main pump, the auxiliary pump, the regulator, the second solenoid proportional valve, and the switching valve are integrated together to collectively serve as a pump unit.

* * * * *